US009323188B2

(12) United States Patent
Matsumoto

(10) Patent No.: US 9,323,188 B2
(45) Date of Patent: Apr. 26, 2016

(54) IMAGE FORMING APPARATUS FOR PREVENTING DEFORMATION OF CONTINUOUS FORMS

(75) Inventor: Tetsuya Matsumoto, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 799 days.

(21) Appl. No.: 13/409,816

(22) Filed: Mar. 1, 2012

(65) Prior Publication Data

US 2012/0230719 A1 Sep. 13, 2012

(30) Foreign Application Priority Data

Mar. 9, 2011 (JP) ..... 2011-052192

(51) Int. Cl.
*G03G 15/20* (2006.01)

(52) U.S. Cl.
CPC ..... *G03G 15/2042* (2013.01)

(58) Field of Classification Search
CPC ..... G03G 15/2042; G03G 15/2082; G03G 15/6517
USPC ..... 399/334, 375, 384
See application file for complete search history.

(56) References Cited

U.S. PATENT DOCUMENTS

| | | | | |
|---|---|---|---|---|
| 4,585,325 | A | 4/1986 | Euler | |
| 5,331,384 | A * | 7/1994 | Otsuka | |
| 2002/0081132 | A1 * | 6/2002 | Miyamoto et al. | 399/384 |
| 2002/0098022 | A1 * | 7/2002 | Kabashima | |
| 2005/0069354 | A1 * | 3/2005 | Nakamura et al. | |
| 2006/0039015 | A1 | 2/2006 | Kageyama et al. | |
| 2009/0273811 | A1 * | 11/2009 | Omata | |

FOREIGN PATENT DOCUMENTS

| | | | | |
|---|---|---|---|---|
| JP | S54-107341 | U | | 7/1979 |
| JP | 06161323 | A | * | 6/1994 |
| JP | 3017604 | | | 3/2000 |
| JP | 2000-137408 | | | 5/2000 |
| JP | 2004-238165 | | | 8/2004 |
| JP | 3580882 | | | 10/2004 |
| JP | 2006215143 | A | * | 8/2006 |
| JP | 2006243509 | A | * | 9/2006 |
| JP | 2007-008143 | | | 1/2007 |
| JP | 2009-053288 | | | 3/2009 |
| JP | 2009-186856 | | | 8/2009 |

OTHER PUBLICATIONS

Japanese Office Action dated Dec. 2, 2014.
Extended European Search Report dated Oct. 20, 2015.

* cited by examiner

*Primary Examiner* — Walter L Lindsay, Jr.
*Assistant Examiner* — Milton Gonzalez
(74) *Attorney, Agent, or Firm* — IPUSA, PLLC

(57) ABSTRACT

In a fixing apparatus of an image forming apparatus, a heating member melts and fixes the unfixed toner. A heat controller controls temperatures of opposite end portion areas and a middle portion area of a surface of the heating member in a width direction perpendicular to a conveyance direction on an individual area basis. A pressure member is pressed against and contacted with the heating member to form a fixing part between the pressure member and the heating member. The heat controller controls the temperatures of the surface of the heating member so that the temperature of at least one of the opposite end portion areas of the surface of the heating member is higher than the temperature of the middle portion area of the surface of the heating member.

22 Claims, 11 Drawing Sheets

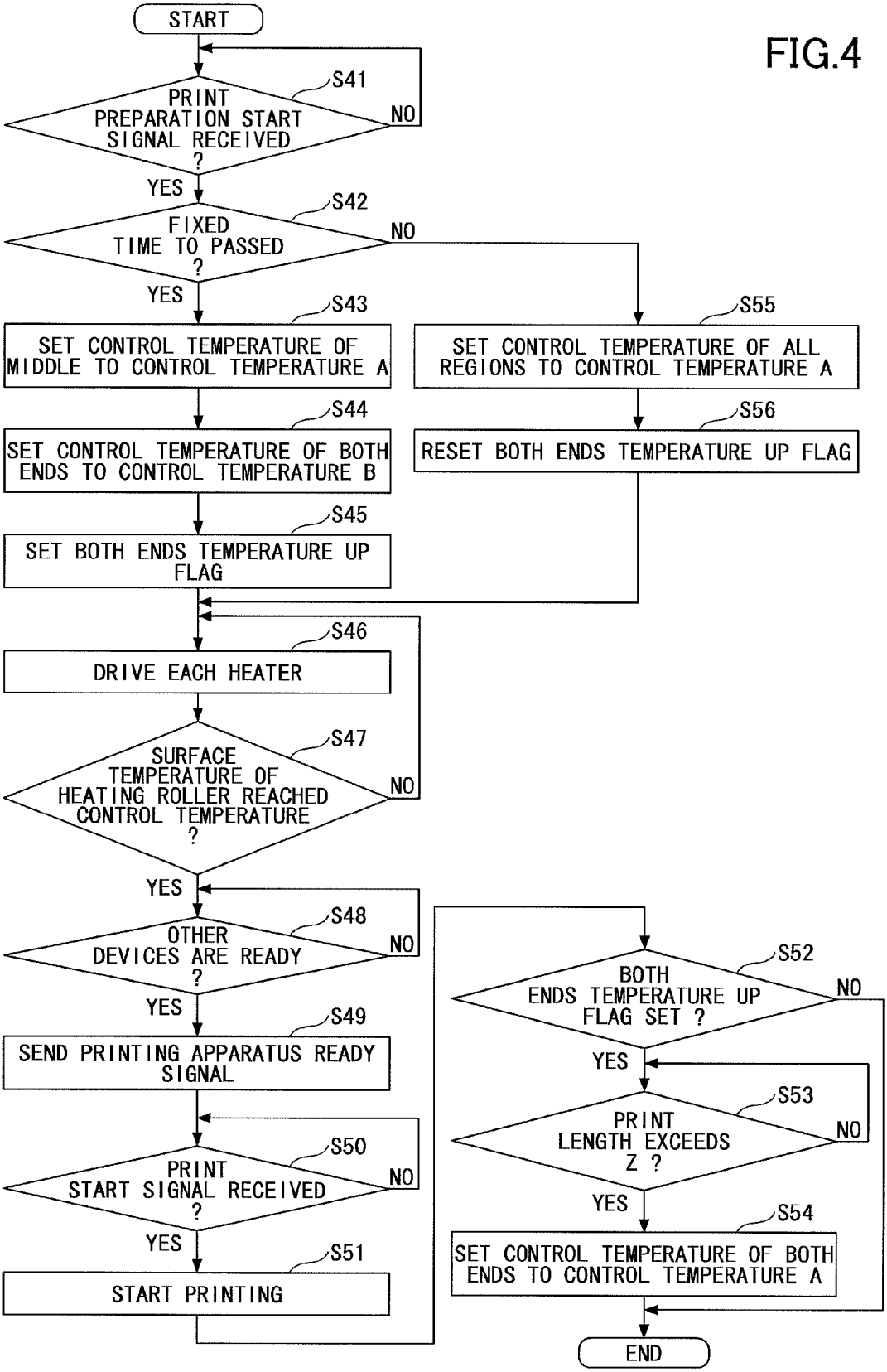
FIG.4
START
S41
PRINT PREPARATION START SIGNAL RECEIVED ?
NO
YES
S42
FIXED TIME TO PASSED ?
NO
YES
S43
SET CONTROL TEMPERATURE OF MIDDLE TO CONTROL TEMPERATURE A
S44
SET CONTROL TEMPERATURE OF BOTH ENDS TO CONTROL TEMPERATURE B
S45
SET BOTH ENDS TEMPERATURE UP FLAG
S55
SET CONTROL TEMPERATURE OF ALL REGIONS TO CONTROL TEMPERATURE A
S56
RESET BOTH ENDS TEMPERATURE UP FLAG
S46
DRIVE EACH HEATER
S47
SURFACE TEMPERATURE OF HEATING ROLLER REACHED CONTROL TEMPERATURE ?
NO
YES
S48
OTHER DEVICES ARE READY ?
NO
YES
S49
SEND PRINTING APPARATUS READY SIGNAL
S50
PRINT START SIGNAL RECEIVED ?
NO
YES
S51
START PRINTING
S52
BOTH ENDS TEMPERATURE UP FLAG SET ?
NO
YES
S53
PRINT LENGTH EXCEEDS Z ?
NO
YES
S54
SET CONTROL TEMPERATURE OF BOTH ENDS TO CONTROL TEMPERATURE A
END

IMAGE FORMING APPARATUS FOR PREVENTING DEFORMATION OF CONTINUOUS FORMS

BACKGROUND OF THE INVENTION

1. Field of the Invention

The present invention relates to an image forming apparatus for forming a toner image on a continuous recording paper such as continuous forms by fixing a toner on the continuous recording paper.

2. Description of the Related Art

An image forming apparatus using an electrophotograpy, such as a copy machine, a laser printer, a facsimile machine, usually uses a printing method for forming a toner image by forming an unfixed toner image on a recording medium and fixing the toner image by applying heat and pressure to the unfixed toner image in a fixing apparatus.

A fixing apparatus usually uses a method of forming a fixed image by applying heat and pressure to a toner and a recording medium while the recording medium having an unfixed toner image is passed through a fixing part during conveyance of the recording medium having the unfixed toner image. The fixing part is formed between a rotating heating member of which surface is heated and a pressure member being pressed onto the heating member.

Such a recording medium used by the image forming apparatus, such as a paper, a cloth, an OHP sheet, etc., may be deformed due to expansion and contraction caused by changes in a temperature and humidity, heat and tension. Especially, such a deformation may occur in a roll paper which is wound on a core material and a continuous recording paper (continuous forms) folded at fixed intervals.

Such a deformation may be caused by a tension force applied to a recording paper while the recording paper is carried by conveyance rollers for a certain time when a printing operation is stopped. Moreover, a deformation may be generated in a continuous recording paper due to excessive heat being applied thereto when a portion of the recording paper was located in the vicinity of a fixing apparatus if the printing operation is interrupted due to a malfunction such as a paper jam. Such a deformation occurs in edge portions of the recording paper in many cases due to expansion and contraction of the recording paper in directions perpendicular to the conveyance direction of the recording paper caused by a heat and a tension force.

It is usual to improve a fixing performance in the fixing part by providing a pre-heating plate incorporating a heater inside thereof at a preceding stage of the fixing part to perform the fixing operation while previously applying heat to the toner and the recording paper. However, if the continuous recording paper is deformed partially, there may be a portion of the recording paper, which portion is not brought into contact with the pre-heating member. Such a partially deformed portion of the recording paper cannot be pre-heated sufficiently. Thus, a sufficient amount of heat cannot be provided to such a partially deformed portion of the recording paper even when the entire recording paper passes through the fixing part. Therefore, a fixing defect may be generated in the recording paper and it becomes difficult to acquire a satisfactory fixed image on the recording paper.

As measures for eliminating such a problem caused by generation of a deformation in a continuous recording paper, Japanese Patent Publication No. 3580882 discloses a recording pre-treatment method including a reformation step of reforming a deformation by conveying a portion of a recording paper including the deformation back and forth in a conveyance direction of the recording paper while applying a tension force to the recording paper by engaging the recording paper with conveyance rollers. This patent document also discloses a recording pre-treatment method including an ejecting step of ejecting a recording paper after cutting a portion of the recording paper, which portion includes a deformation, by a cutting mechanism for the recording paper.

According to the recording pre-treatment methods disclosed in the above-mentioned Japanese Patent Publication No. 3580882, a deformed portion of the recording paper is automatically reformed or the deformed portion is automatically ejected to outside the apparatus. Thus, a defective printing such a drop of an image and a printing failure such as a paper jamming may be prevented beforehand because the recording paper used for printing is set in a normal state.

However, there is a case where the pre-treatment methods disclosed in the above-mentioned patent document cannot completely reform or correct a deformed portion of a continuous recording paper (continuous forms). Additionally, there may be a case where it is difficult to cut out and eject a deformed portion of a recording paper by recognizing an accurate position of the deformed portion of the recording paper where a deformation is generated. Further, a manufacturing cost of a printing apparatus may be increased because an additional mechanism, such as a forward and rearward conveyance mechanism of a recording paper and a paper cutting mechanism, must be incorporated into the printing apparatus.

SUMMARY OF THE INVENTION

It is a general object of the present invention to provide an image forming apparatus in which the above-mentioned problems are eliminated.

A more specific object of the present invention is to provide an image forming apparatus which can form a fixed image having no defect on a continuous recording paper even when a deformation is generated in the continuous recording paper due to heat or a tension force being applied to the continuous recording paper.

In order to achieve the object, there is provided according to one aspect of the present invention an image forming apparatus including a printing apparatus that includes a fixing apparatus, the fixing apparatus including: a pre-heating member configured to preheat an unfixed toner transferred to a continuous recording medium being conveyed; a heating member configured to melt and fix the unfixed toner; a heat controller configured to control temperatures of opposite end portion areas and a middle portion area of a surface of the heating member in a width direction perpendicular to a conveyance direction of the continuous recording medium on an individual area basis; a pressure member configured to be pressed against and contact with the heating member; and a fixing part formed between the heating member and the pressure member, the unfixed toner being fixed in the fixing part, wherein the heat controller controls the temperatures of the surface of the heating member so that the temperature of at least one of the opposite end portion areas of the surface of the heating member is higher than the temperature of the middle portion area of the surface of the heating member.

There is provided according to another aspect of the invention an image forming apparatus including a printing apparatus that includes a first and second fixing apparatuses, each of the first and second fixing apparatuses including: a pre-heating member configured to preheat an unfixed toner transferred to a continuous recording medium being conveyed; a heating member configured to melt and fix the unfixed toner;

a heat controller configured to control temperatures of a surface of the heating member; a pressure member configured to be pressed against and contact with the heating member; and a fixing part formed between the heating member and the pressure member, the unfixed toner being fixed in the fixing part, wherein the first fixing apparatus fixes the unfixed toner on one side of the continuous recording medium, and the second fixing apparatus is located on a downstream side of the first fixing apparatus in a conveyance direction of the continuous recording medium so as to fix the unfixed toner on the other side of the continuous recording medium, and wherein the heat controller of the second fixing apparatus controls the temperatures of opposite end portion areas of the surface of the heating member of the second fixing apparatus and the temperature of a middle portion area of the surface of the heating member of the second fixing apparatus in a width direction perpendicular to a conveyance direction of the continuous recording medium on an individual area basis, and wherein, when a printing operation is stopped due to a failure and thereafter the printing operation is resumed, and when a portion of the continuous recording medium that has been located in the fixing part of the first fixing apparatus passes through the fixing part of the second fixing apparatus, the heat controller of the second fixing apparatus controls the temperatures of the surface of the heating member of the second fixing apparatus so that the temperature of at least one of the opposite end portion areas of the surface of the heating member of the second fixing apparatus is higher than the surface temperature of the middle portion area of the surface of the heating member of the second fixing apparatus.

There is provided according to another aspect of the invention an image forming method including: supplying and conveying a continuous recording medium; forming an unfixed toner on the continuous recording medium; preheating the unfixed toner together with the continuous recording medium; and fixing the unfixed toner on the continuous recording medium by applying heat from a heating member to the unfixed toner and the continuous recording medium while controlling a temperature of at least one of opposite end portion areas of a surface of the heating member in a width direction perpendicular to a conveyance direction of the continuous recording medium to be higher than a temperature of a middle portion area of the surface of the heating member.

According to the above-mentioned structure, a printed image having no defect such as a fixing defect can be obtained even when a deformation is generated in an end portion of the continuous recording paper in a width direction perpendicular to a conveyance direction of the continuous recording paper.

According to an embodiment of the present invention, a fixing defect is prevented from being generated and a good fixed image can be obtained even when there is a deformation generated in an end portion of a continuous recording paper in a width direction perpendicular to a conveyance direction of the continuous recording paper due to heat or a tension force being applied to the continuous recording paper.

Other objects, features and advantages of the present invention will become more apparent from the following detailed description when read in conjunction with the accompanying drawings.

BRIEF DESCRIPTION OF THE DRAWINGS

FIG. 4 is a flowchart of a temperature control process of a heating roller provided in the fixing apparatus of the image forming apparatus according to the first embodiment;

DETAILED DESCRIPTION OF THE PREFERRED EMBODIMENTS

A description will be given below, with reference to the drawings, of embodiments of the present invention.

First Embodiment

Figure 1:
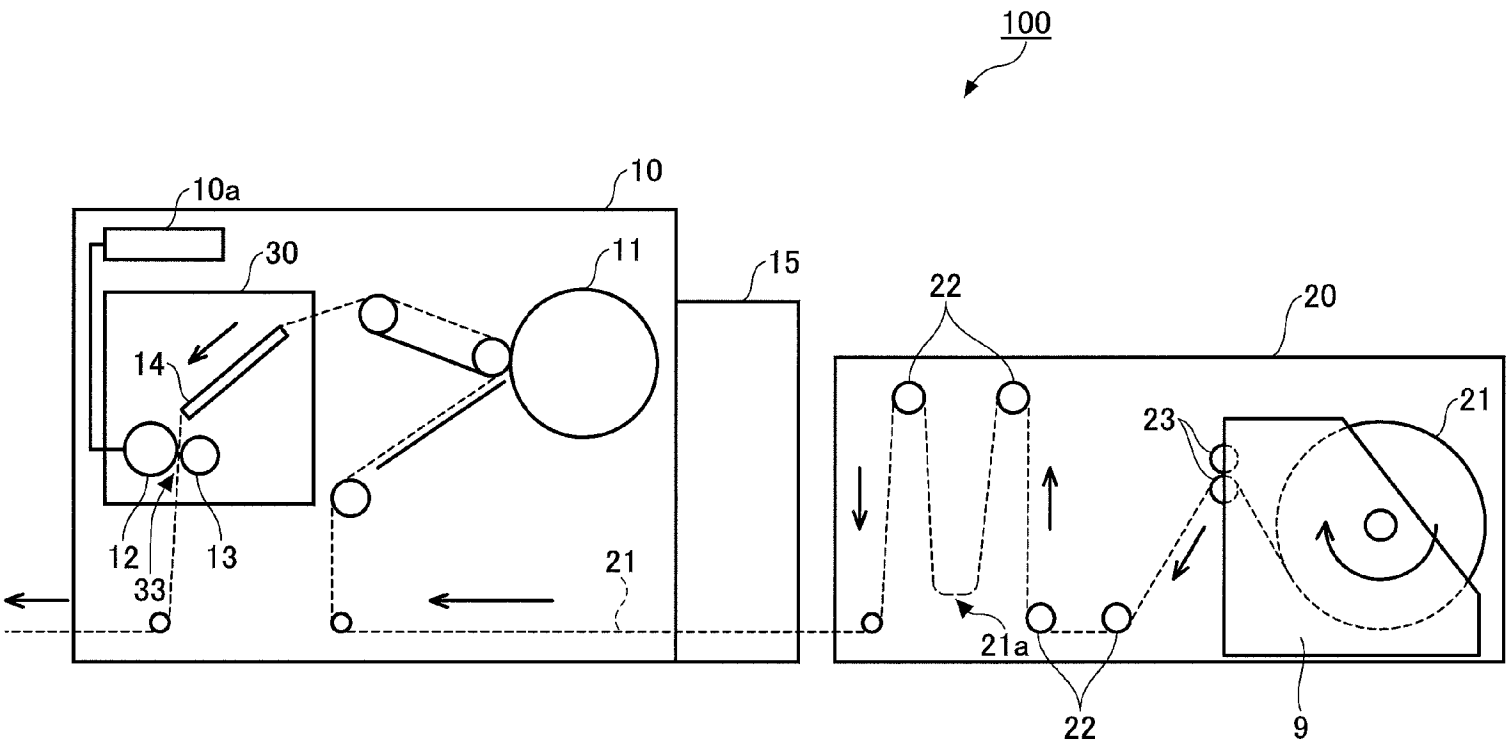
FIG. 1 is a view illustrating a structure of an image forming apparatus according to a first embodiment of the present invention.

FIG. 1 illustrates a structure of an image forming apparatus according to a first embodiment of the present invention.

The image forming apparatus 100 according to the first embodiment of the present invention includes a printing apparatus 10, a print control apparatus 15 and a conveyance apparatus 20. The printing apparatus 10 forms a toner image on a continuous recording paper (continuous forms) 21. The continuous recording paper 21 may be belt-like continuous forms containing a series of form sheets connected one after another. Hereinafter, the continuous recording paper 21 may be simply referred to as a recording paper 21. The print control apparatus 15 controls printing operations of the printing apparatus 10. The print control apparatus may be incorporated into the printing apparatus 10. The conveyance apparatus 20 stores and conveys the recording paper 21 which is wound on a core material in a roll form.

The printing apparatus 10 is equipped with a photosensitive drum 11, a fixing apparatus 30 and a plurality of rollers for conveying the recording paper 21. Although not illustrated in the figure, a charge unit, an exposure unit, a development unit, a transfer unit, a cleaning unit, etc., are provided and arranged around the photosensitive drum 11. The charge unit applies an electric charge onto the photosensitive drum 11. The exposure unit exposes the surface of the photosensitive drum 11. The development unit forms a toner image by attaching a toner onto the surface of the photosensitive drum 11. The transfer unit transfers the toner image to the recording paper 21. The cleaning unit removes the toner which has not been transferred and remaining on the surface of the photosensitive drum 11.

In the above-mentioned printing apparatus 10, the toner image formed on the photosensitive drum 11 is transferred to the recording paper 21 having been conveyed from the conveyance apparatus 20. A fixed image is formed by applying heat and pressure to the toner image in the fixing apparatus 30. The printing apparatus 10 then ejects the recording paper 21 having the fixed image thereon to outside.

The conveyance apparatus 20 includes a supply apparatus 9, which stores and supplies the recording paper 21, and a plurality of conveyance rollers 22 and 23 which retain and convey the recording paper 21 while applying a fixed tension force to the recording paper 21. In the conveyance apparatus 20, the recording paper 21 stored in the supply apparatus 9 is fed by the conveyance rollers 23 when a length of a portion of the recording paper 21 retained between the conveyance rollers 22 becomes shorter than a predetermined length so that a length of a slack (indicated by 21*a* in FIG. 1) of the recording paper 21 between the conveyance rollers 22 is maintained in a predetermined range. The recording paper 21 is fed from the conveyance apparatus 20 to the printing apparatus. Although the conveyance apparatus 20 is provided outside the printing apparatus 10 in the present embodiment, the conveyance apparatus 20 may be incorporated into the printing apparatus 10 to supply and feed the recording paper 21 to the printing mechanism inside the printing apparatus 10.

Figure 2:
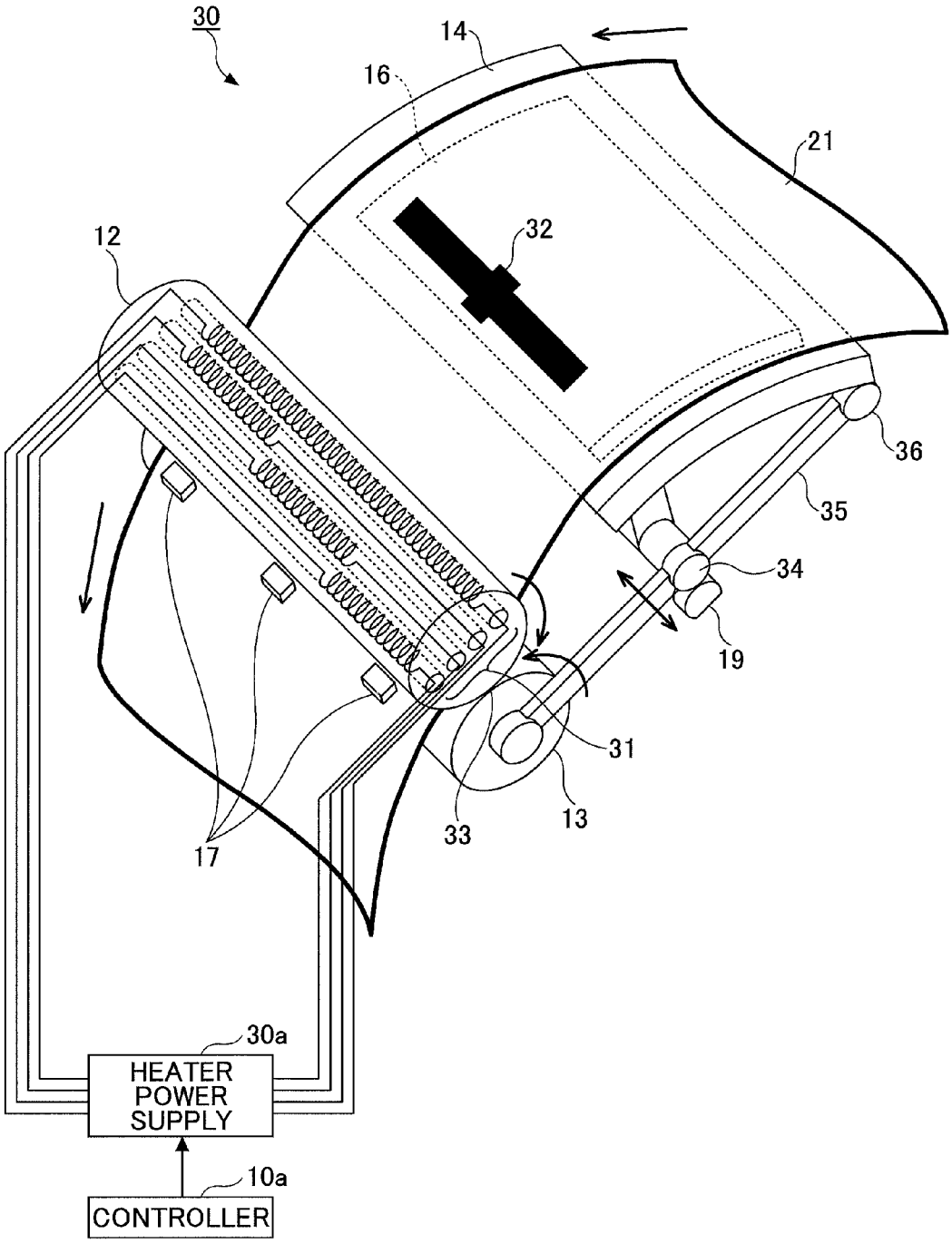
FIG. 2 is a perspective view of a mechanical structure of a fixing apparatus incorporated in the image forming apparatus according to the first embodiment.

FIG. 2 illustrates a mechanical structure of the fixing apparatus 30.

The continuous recording paper 21 having an unfixed toner image 32 is conveyed to the fixing apparatus 30. First, when the recording paper 21 passes above a pre-heating plate 14, the recording paper 21 is heated to a predetermined temperature. Then, the recording paper 21 is applied with heat and pressure, when the recording paper 21 passes through a fixing part 33 which is formed between a heating roller 12 and a pressure roller 13 facing the heating roller 12, so that the toner image is melted and fixed to the recording paper 21.

A heater 16 is incorporated in the pre-heating plate 14 in order to heat the surface of the pre-heating plate 14. The pre-heating plate 14 preheats the recording paper 21 before the recording paper 21 passes through the fixing part 33.

The heating roller 12 incorporates a heater unit 31 including a plurality of heaters inside thereof. A power supplied to the heater unit 31 is controlled so that the surface temperature of the heating roller 12 is set to a predetermined temperature when a fixing process is performed. In the present embodiment, the heater unit 31 includes four heaters, one of which heats the entire surface of the heating roller 12 and the rest of the heaters (three heaters in the present embodiment) heat the respective portions of the surface of the heating roller 12. That is, the three heaters partially heat the respective areas of the surface of the heating roller 12 which areas face opposite end portions of the recording paper 21 in a direction perpendicular to a conveyance direction (a longitudinal direction) of the recording paper 21 and a middle portion of the recording paper 21 between the opposite end portions.

Although the length of each of the heaters of the heater unit 31 may be set in accordance with the continuous recording paper to use, the heaters corresponding to the opposite end portions can control the fixing temperature in a length of 0 mm to 230 mm from each of the opposite ends of the heating roller 12. The heater corresponding to the middle portion can control the fixing temperature in a length of 150 mm to 200 mm excluding the lengths corresponding to the opposite end portions.

The heaters of the heater unit 31 are halogen heaters in the present embodiment. The opposite ends of each of the heaters are fixed to side portions of the heating roller 12, respectively. The heater unit 31 is driven by a heater power supply 30*a* as a power supply so that a power is supplied to the plurality of heaters of the heater unit 31 on an individual heater basis to heat the heating roller 12 from inside by radiation heat of the heater unit 31. A power supply operation of the heater power supply 30*a* is controlled by a controller 10*a* provided in the printing apparatus 10. The controller 10*a* for controlling the heater power supply 30*a* may be incorporated into the print control apparatus 15. Additionally, the heater power supply 30*a* and the controller 10*a* may be incorporated into the fixing apparatus 30.

Although the heater unit 31 is incorporated into the heating roller 12, the surface of the heating roller 12 may be heated from outside. As the heater unit 31, a carbon heater, a ceramic heater, an induction heater, etc., may be used. In any cases, it is desirable to configure and arrange the heater unit 31 to be capable of controlling a temperature for each of the opposite end portions and the middle portion of the recording paper in a direction perpendicular to a conveyance direction of the recording paper.

The heating roller 12 includes a cylindrical member and an elastic layer covering the cylindrical member. The cylindrical member is made of a metal material such as aluminum. The elastic layer is made of an elastic material such as silicone rubber. The surface of the elastic layer is coated with a mold releasing layer using a fluorocarbon resin. The cylindrical member may be made of a metal or an alloy having an excellent mechanical strength and a good thermal conductivity, such as stainless steel, steel, brass, etc. The elastic layer may be made of a material having a heat resistance, and, for example, fluorocarbon rubber may be used other than silicone rubber. The mold releasing layer may be made of fluorocarbon resin such as PFA (perfluoro alkyl vinyl ether) and PTFE (polytetra fluoroethylene).

Moreover, a fixing belt may be used as a heating member. The fixing belt is an endless belt rotated by a plurality of rollers of which surface is heated at a fixing temperature from inside or outside the belt.

The pressure roller 13 is supported by support members 35 that are pivoted about a rotation shaft 34 as a center of rotation. The support members 35 are swung about a supporting point shaft 36 by a cam 19 being rotated so that the pressure roller 13 is brought into contact with and separated from the heating roller 12. When starting a fixing operation, the cam 19 is rotated by a rotating means (not illustrated in the figure) in order to form a fixing part 33 between the heating roller 12 and the pressure roller 13.

Similar to the heating roller 12, the pressure roller 13 includes a cylindrical member and an elastic layer covering the cylindrical member. The cylindrical member is made of a metal material such as aluminum. The elastic layer is made of an elastic material such as silicone rubber. The surface of the elastic layer is coated with a mold releasing layer using a fluorocarbon resin. A roller having an elastic material on the surface thereof as mentioned above or a flat plate member having an elastic member may be used as a pressure member. An elastic member configured and arranged to apply a pressure to the heating member from inside an endless fixing belt may be used.

Melting of the unfixed toner image 32 on the recording paper 21 is promoted by receiving heat from the back surface of the recording paper 21 when the recording paper 21 passes above the pre-heating plate 14. The unfixed toner image 32 is melted and fixed to the surface of the recording paper 21 by further receiving heat and pressure when the unfixed toner image 32 passes through the fixing part 33.

A temperature control of the surface temperature of the heating roller 12 is performed to maintain the surface temperature at a fixing temperature. The temperature control is performed by varying a time to supply electric power to the heater unit 31 based on results of detection of each area by temperature detection elements 17 such as thermistors.

Here, if a printing operation of the image forming apparatus 100 is stopped for a long time, the recording paper 21 waiting for a start of another printing operation is maintained in a state where a certain tension force is applied to the recording paper 21 by the conveyance rollers 22 and 23 in the conveyance apparatus 20. Thus, partial deformation of a shape along the conveyance rollers 22 and 23 may be generated in portions of the recording paper 21 which are carried by the conveyance rollers 22 and 23.

Figure 3:
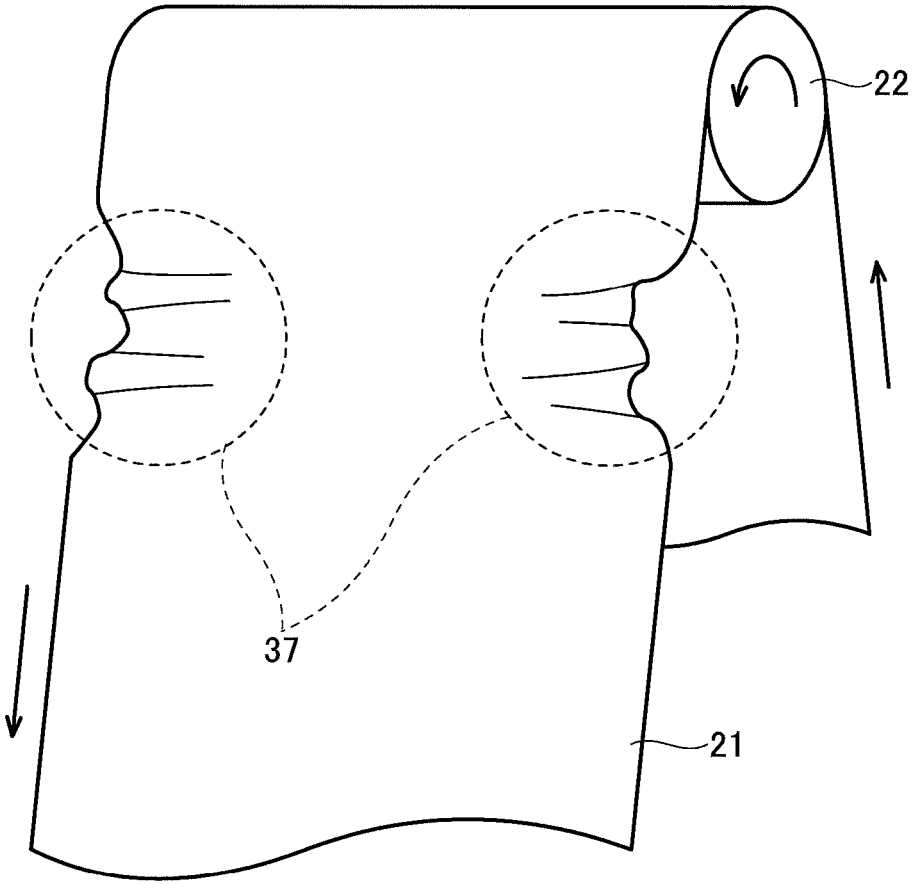
FIG. 3 is a perspective view of a portion of a recording paper where a deformation is generated.

FIG. 3 illustrates an example of the recording paper 21 in which deformation is generated by the conveyance rollers 22 and 23. That is, as a result of the recording paper 21 being applied with a tension force in portions in engagement with the conveyance rollers 22 and 23 for a long time, a deformation 37 is generated in each of the opposite end portions of the recording paper 21 due to expansion and contraction of the recording paper 21. The deformation 37 generated by the conveyance rollers 22 and 23 is generated in the opposite end portions in a width direction perpendicular to a conveyance direction of the recording paper 21.

When a printing operation is started after a certain stop period, the recording paper 21 having the deformation 37 is conveyed and is subjected to the printing operation in the printing apparatus 10. At that time, the opposite end portions of the recording paper 21 having the deformation 37 may be partially lifted and separated from the pre-heating plate 14, and, thus, the recording paper 21 cannot receive heat from the pre-heating plate 14. As a result, preheating of the deformed portions of the recording paper 21 is insufficient, and, thereby, the toner image cannot be satisfactorily fixed even when the deformed portions of the recording paper 21 are passed through the fixing part 33 thereafter.

In such a case, if the surface temperature of the heating roller 12 is raised in all areas in order to compensate for an amount of insufficient heat, the middle portion of the heating roller 12 is excessively heated by a sufficient heat having been applied by the preheating, which results in generation of uneven fixing due to the excessive heating.

Thus, the fixing apparatus 30 according to the present embodiment controls the temperature of the opposite end portions of the heating roller 12 to be higher than the temperature of the middle portion of the heating roller 12 by the plurality of heaters of the heater unit 31 provided inside the heating roller 12 when the recording paper 21 having the deformation 37 passes through the fixing part 33. The unevenness in the fixing temperature is eliminated by applying sufficient heat to the opposite end portions of the recording paper 21 where the preheating is insufficient. Thus, the toner image can be fixed without any defect over an entire area of the recording paper 21. For example, when the recording paper having the deformation being generated therein passes through the fixing part 33, the temperature of the end portions of the heating roller 12 is raised from the normal temperature of the middle portion of the heating roller 12 by 10° C. to 25° C. to perform a fixing operation.

FIG. 4 illustrates a flowchart of a temperature control process of heating the heating roller 12 of the fixing apparatus 30 according to the first embodiment of the present invention.

First, it is determined in step S41 whether a print preparation start signal is received. When the print preparation start signal is received, it is determined in step S42 whether a predetermined fixed time T0 is passed after stopping a printing operation. The fixed time T0 is a period of time from stopping the printing operation to a time when a deformation is generated in a portion of the recording paper 21 retained by the conveyance rollers 22 and 23 in the conveyance apparatus 20. The fixed time T0 is previously determined depending on a kind of the recording paper 21.

If it is determined in step S42 that the print stop time is shorter than the fixed time T0, the process proceeds to step S55 to set the control temperature of the entire area of the surface of the heating roller 12 to a control temperature A for printing. The control temperature A for printing is previously determined according to a ream weight of the recording paper 21 to be subject to printing. Usually, the temperature is set higher as the ream weight is larger. Then, a reset of a both ends temperature up flag is performed in step S56, and the process proceeds to step S46 mentioned later.

On the other hand, if it is determined in step S42 that the print stop time is equal to or longer than the fixed time T0, the process proceeds to step S43 to set the control temperature of the middle portion of the heating roller 12 to the control temperature A. Then, the control temperature of the opposite end portions of the heating roller 12 is set, in step S44, to a control temperature B.

The control temperature B is a temperature which is raised from the control temperature A by 10° C. to 25° C. in order to maintain a fixing property even in the end portions of the recording paper where deformation is generated. The temperature of each of the opposite end portions may be operated independently so that the control temperature of one of the opposite end portions is higher than the other.

Then, the both ends temperature flag is set in step S45, and each heater of the heater unit 31 is driven, in step S46, to achieve the control temperature set for each portion as a target. Then, it is determined in step S47 whether each area of the surface of the heating roller 12 has reached the control temperature. If it is determined that each area of the surface of the heating roller 12 has reached the control temperature, the process proceeds to step S48 where it is determined whether preparation of other apparatuses of the printing apparatus, such as the charge apparatus, the development apparatus, the transfer apparatus, etc., has completed. If the preparation of all other apparatuses has completed, the process proceeds to step S49 where a printing apparatus READY signal representing a completion of print preparation of the printing apparatus 10 is sent to the print control apparatus 15.

Subsequently, it is determined in step S50 whether or not a print start signal is received from the print control apparatus 15. If the print start signal is received, the process proceeds to step S51 to start printing.

After start printing, it is determined in step S52 whether the both ends temperature up flag is set. If the flag is set, the process proceeds to step S53 where a length of the recording paper 21 on which the printing operation was performed exceeds a length Z. If it is determined that the length of the recording paper 21 on which the printing operation was performed exceeds the length Z, the process proceeds to step S54 to set the control temperature of the opposite end parts of the heating roller 12 to the control temperature A for printing. Thereafter, the heater unit 31 is driven to achieve the control temperature A as a target in the entire area of the surface of the heating roller 12.

Here, the above-mentioned length Z is a length of a conveyance path from the farthest conveyance roller 23 to the printing apparatus along the conveyance path of the recording paper 21 to the fixing part 33 of the fixing apparatus 30. The length Z may be previously set by an operator using the image forming apparatus 10 based on the structure of the apparatus. Alternatively, the length Z may be set based on a number of pages of the recording paper 21 counted during a period in which the recording paper 21 can be conveyed from the conveyance roller 23 to the fixing part 33.

Figure 5:
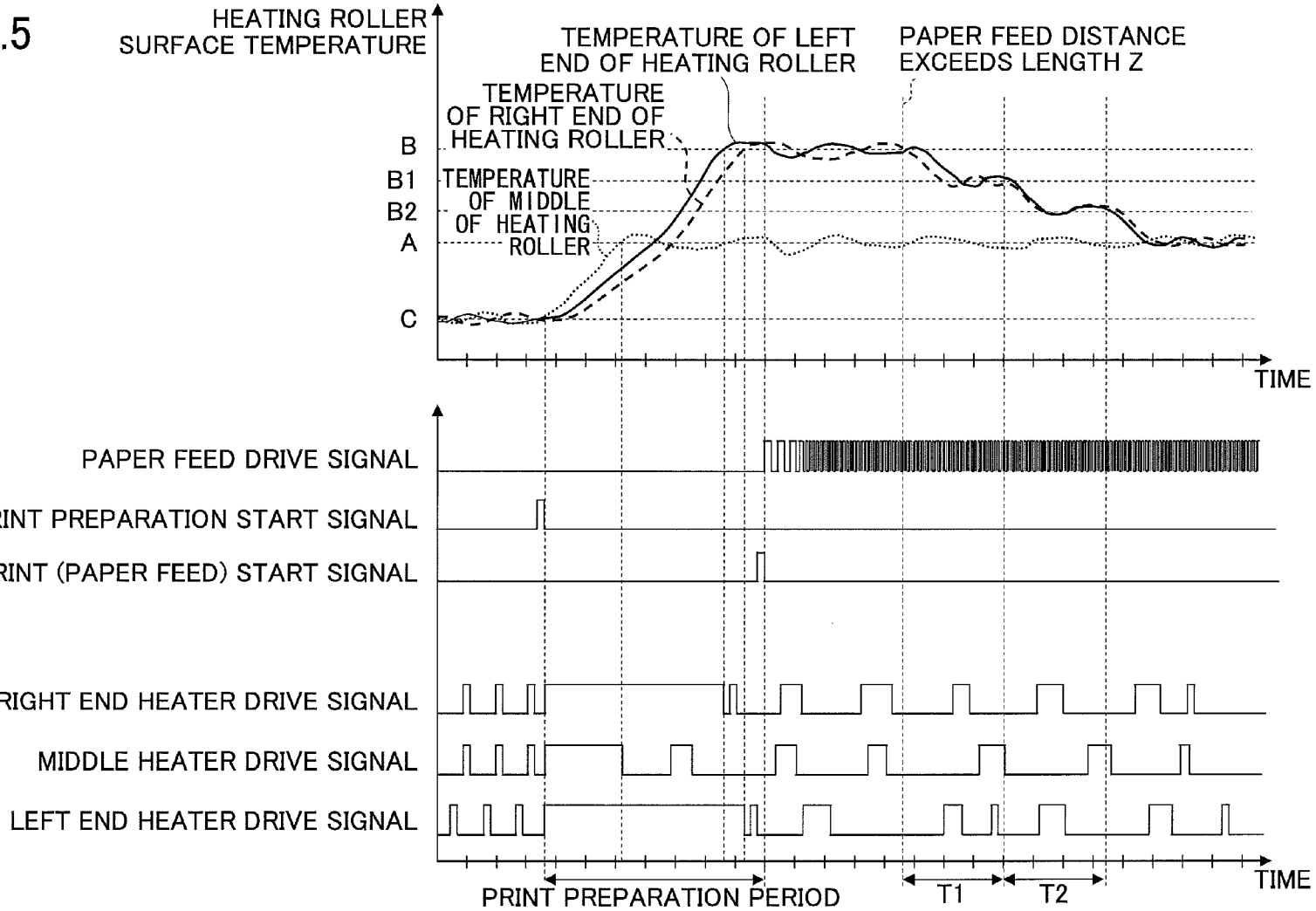
FIG. 5 is a time chart of a change in a temperature of a heating roller and paper feed signals and heater drive signals.

FIG. 5 illustrates an example of temperature changes of the surface of the heating roller 12 and a control of the temperature in the fixing apparatus 30 according to the first embodiment. In FIG. 5, the vertical axes represent the temperature of each area of the surface of the heating roller measured by the temperature detection elements 17 and an output value of each signal, and the horizontal axis represents a time.

First, while a printing operation is stopped, the heater unit 31 inside the heating roller 12 is driven to achieve a control temperature C as a target for non-printing time. When a print preparation start signal is received from the print control apparatus 15 after the printing stop time becomes equal to or longer than the fixed time T0, the heater unit 31 is driven in the fixing apparatus 30 to achieve the control temperature B as a target for the opposite end portions of the heating roller 12. The heater of the heater unit 31 for heating the middle portion of the heating roller 12 is driven to achieve the normal print control temperature A as a target. The control temperature A is higher than the control temperature C for non-printing time by 5° C. to several tens degrees (° C.).

The temperatures of the surface of the heating roller 12 in the areas reach the respective control temperatures, and the printing apparatus 10 sends a signal to the print control apparatus 15 representing that printing can be performed. Thereafter the printing apparatus 10 receives a print start signal from the print control apparatus 15, and starts a printing operation (paper conveyance).

After starting the printing operation, when the conveyance distance of the recording paper 21 exceeds the length Z, the control temperature of the opposite end portions of the heating roller 12 is changed to the normal print control temperature A in order to lower the temperature.

Here, if the control temperature B of the opposite end portions is changed immediately at once to the control temperature, it is set to a condition where the heaters of the heater unit 31 for heating the opposite end portions are not driven until the output values of the temperature detection elements 17 reach temperatures below the control temperature A. Although it depends on the output response of the temperature detection elements 17, even if the temperature of the opposite end portions is actually at a temperature below the control temperature A, it takes a certain time to detect the temperature below the control temperature A. Accordingly, during a time period after the lowered temperature is detected but before the temperature is raised again, the temperature required by fixing is not reached, and, therefore, it is possible that a fixing defect occurs. Especially, if a thermistor is used as the temperature detection element 17, the output response characteristic is deteriorated. Thus, because it tends to take a long time from a time when the temperature is lowered until a time when the temperature returns to a normal fixing temperature, there is a high possibility of generating a fixing defect.

Thus, it is desirable to gradually lower the temperature to the control temperature A by dividing the temperature range into several stages from the control temperature B to the control temperature A without changing from the control temperature B to the control temperature A at once.

In the fixing apparatus 30 according to the present embodiment, the temperature control is performed by dividing the temperature range between the control temperature B and the control temperature A into two stages. Specifically, if the conveyance length of the recording paper 21 exceeds the length Z, first, the temperature of the opposite end portions is changed from the control temperature B to a control temperature B1. Thereafter, when a fixed time T1 with which the output response of the temperature detection element 17 can follow the temperature change has passed, the control temperature is changed to a control temperature B2. In the same manner, when a fixed time T2 with which the output response of the temperature detection element 17 can follow the temperature change has passed, the control temperature is changed to the control temperature A. Thereafter, during the printing operation, similar to the normal printing, the heater unit 31 is driven so that the control temperature A is achieved in all areas of the surface of the heating roller 12. By controlling the fixing temperature to be lowered stepwisely, the fixed image can be formed without generating a fixing defect due to a temperature decrease even after the deformed portion of the recording paper passes through the fixing part 33. The number of steps of controlling the fixing temperature may be any number if a time when the fixing temperature becomes a temperature blew below the normal fixing temperature is reduced.

As explained above, in the image forming apparatus 100 according to the first embodiment of the present invention, no fixing defect occurs and a good fixed image can be obtained by controlling the temperature of the opposite end portions of the heating roller 12 to be higher than the temperature of the middle portion of the heating roller 12. This remains true even when a fixing operation is performed on the recording paper 21 having ends which are deformed due to reception of a tension force during a stop period of a printing operation being longer than a fixed time during which the recording paper 21 is retained by the conveyance rollers 22 and 23 of the conveyance apparatus 20.

Second Embodiment

Figure 6:
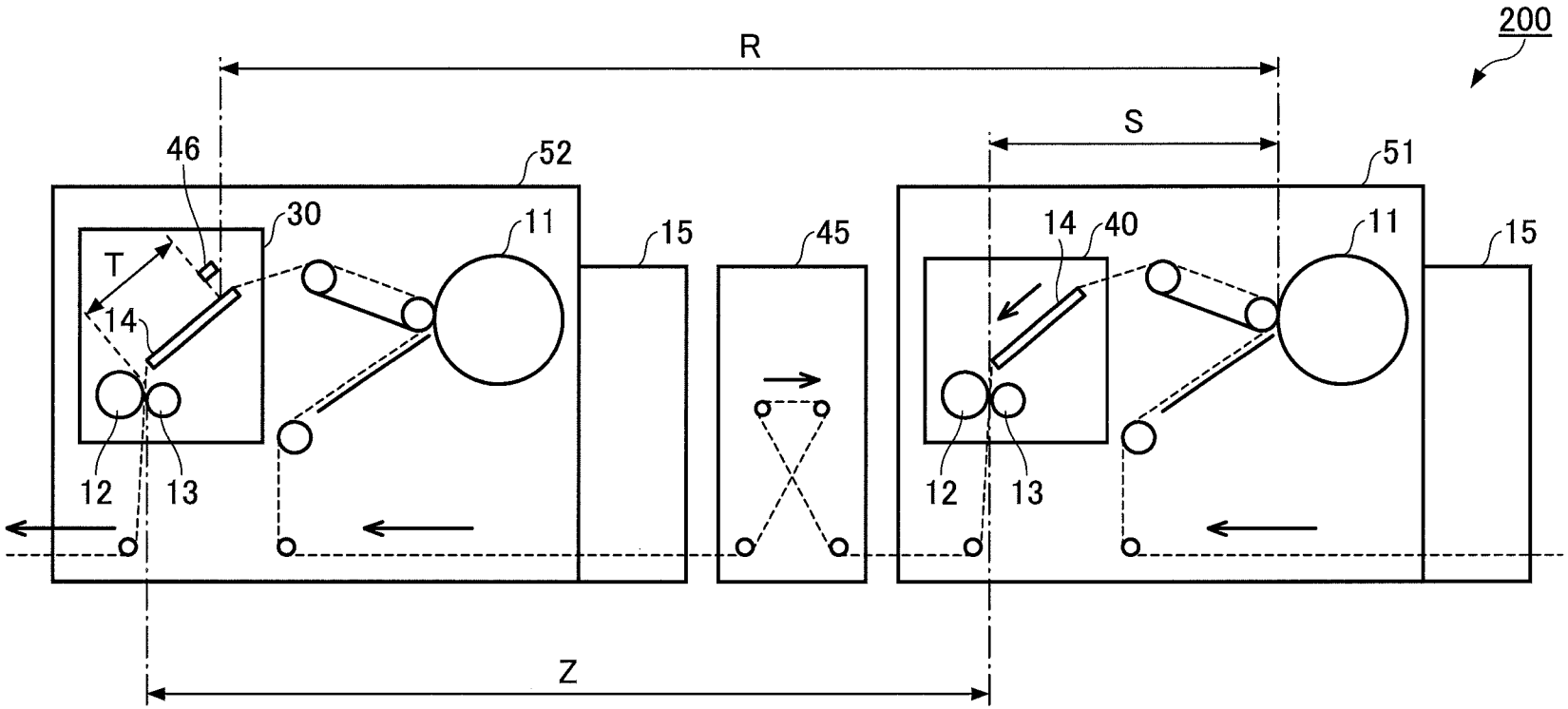
FIG. 6 is a view illustrating a structure of an image forming apparatus according to a second embodiment of the present invention.

FIG. 6 illustrates a structure of an image forming apparatus 200 according to a second embodiment of the present invention.

The image forming apparatus 200 includes a first printing apparatus 51, a first print control apparatus 15 for controlling the first printing apparatus 51, a recording-paper reversing apparatus 45, a second printing apparatus 52, and a second print control apparatus 15 for controlling the second printing apparatus 52. The first printing apparatus 51 prints a toner image on one side of the continuous recording paper 21 being conveyed. The recording-paper reversing apparatus 45 reverses the recording paper 21 ejected from the first printing apparatus 51. The second printing apparatus 52 prints a toner image on the other side of recording paper 21.

Each of the printing apparatuses 51 and 52 has the same structure as the printing apparatus 10 according to the first embodiment mentioned above in order to form a toner image on the recording paper 21. Although not illustrated in FIG. 6, each of the printing apparatuses 51 and 52 includes a heater power supply and a controller for heating the heater power supply such as illustrated in FIG. 2. According to the above-mentioned structure, the image forming apparatus 200 is capable of performing double-side printing on the continuous recording paper 21.

Here, there may be a case in which, during execution of a double-side printing operation on the recording paper 21 by the image forming apparatus 200, an operator of the apparatus temporarily stops the printing operation or the printing operation is temporarily interrupted due to a failure such as paper jamming. In such a case, the continuous recording paper 21 is prevented from being continuously heated while the printing operation is stopped by rotating the cam 19 to separate the pressure roller 13 from the heating roller 12 in each of the fixing apparatuses 30 and 40.

Figure 7:
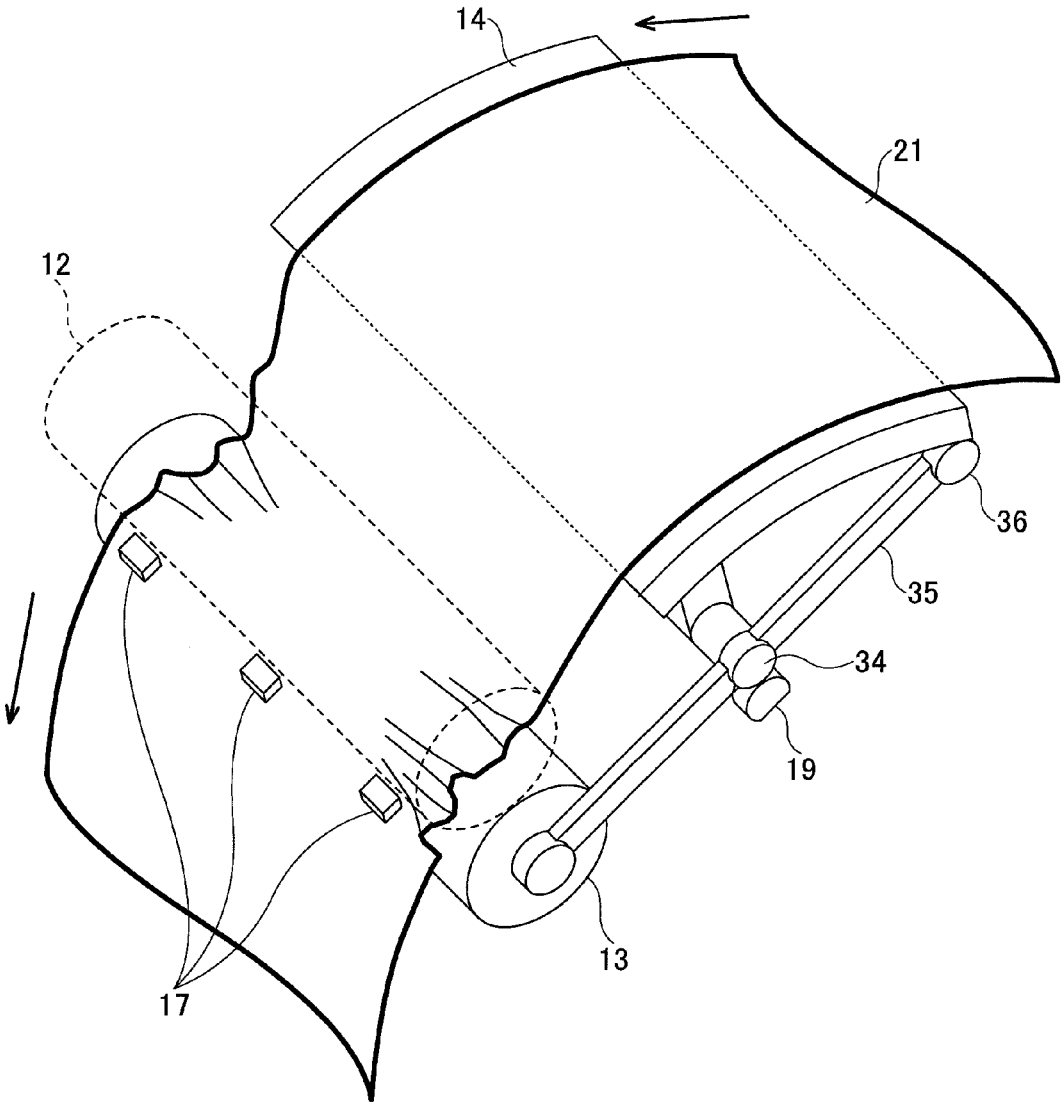
FIG. 7 is a perspective view of a portion of a recording paper that has been located in the vicinity of a fixing part.

However, if a period of time of stopping the printing operation becomes long, the recording paper 21 located in the vicinity of the fixing part 33 is continuously given an influence of heat from the heating roller 12, which is controlled to be at a high-temperature, even though the recording paper 21 is not in contact with the heating roller 12. In such a case, as illustrated in FIG. 7, the recording paper located in the vicinity of the fixing part 33 may expand and contract due to an influence of heat, which results in a deformation generated in the recording paper 21.

Also in such a case, similar to the deformation generated in the portions of the recording paper 21 retained by the conveyance rollers 22 and 23 in the first embodiment, a deformation is generated in each of opposite ends of the recording paper 21 in a width direction perpendicular to a conveyance direction of the recording paper 21.

When the printing operation is resumed after the above-mentioned deformation is generated in the fixing apparatus 40 of the first printing apparatus 51, the continuous recording paper 21 is conveyed by being reversed by the recording-paper reversing apparatus 45 and is supplied to the second printing apparatus 52. At that time, the portion of the continuous recording paper 21 having the deformation is not sufficiently preheated by the pre-heating plate 14 of the fixing apparatus 30. Thus, if fixation is performed at a normal printing temperature, it is difficult to obtain a satisfactory image due to a fixing defect.

In such a case, when performing a fixing operation on a portion of the recording paper 21 having a deformation by the fixing apparatus 30 of the second printing apparatus 52, the surface temperature of the heating roller 12 of the fixing apparatus 30 is controlled so that the temperature of the opposite ends of the recording paper 21 in the width direction perpendicular to the conveyance direction of the recording paper 21 is higher than the printing temperature. The temperature control of the heating roller 12 in the fixing apparatus 30 is the same as the temperature control in the first embodiment.

Here, because the image forming apparatus 200 according to the second embodiment includes the recording-paper reversing apparatus 45, a length of the conveyance path of the recording paper 21 differs depending on the arrangement of the recording-paper reversing apparatus 45. Accordingly, it is difficult to previously grasp the above-mentioned length Z of the conveyance path. Thus, the operator of the image forming apparatus 200 must set the length Z to the print control apparatus 15 by, for example, counting a number of pages of the recording paper 21 contained in the length Z.

Moreover, the length Z of the conveyance path can be computed by printing a check mark on a predetermined position on the recording paper 21 by the first printing apparatus 51 and providing a sensor 46 for detecting the check mark. For example, a length S of the conveyance path from a position where an image is transferred to the recording paper 21 by the first printing apparatus 51 to the fixing part 33 of the fixing apparatus 40 is previously determined when designing the first printing apparatus 51. A length T of the conveyance path from the sensor 46 in the second printing apparatus 52 to the fixing part 33 of the fixing apparatus 30 is also previously determined. Thus, a length R of the conveyance path can be acquired from an amount of conveyance of the recording paper from a time when the check mark is transferred to the recording paper 21 in the first printing apparatus 51 to a time when the check mark is detected by the sensor 46 of the second printing apparatus 52. Accordingly, a length from the fixing apparatus 40 of the first printing apparatus 51 to the fixing apparatus 30 of the second printing apparatus 52 can be calculated as $Z=R-S+T$.

The check mark printed on the recording paper 21 can be used for checking consistency of double-side printing data, when performing double-side printing, by performing the printing operation while sequentially detecting the position of the check mark.

As explained above, in the image forming apparatus 200 according to the second embodiment of the present invention, no fixing defect occurs and a good fixed image can be obtained by controlling the temperature of the opposite end portions of the heating roller 12 to be higher than the temperature of the middle portion of the heating roller 12 at the time of fixing in the fixing apparatus 30 of the second printing apparatus 52 even when a printing operation is stopped for a time longer than a fixed time and the recording paper 21 is deformed due to reception of heat in the fixing part 33 of the first print apparatus 51.

Third Embodiment

Figure 8:
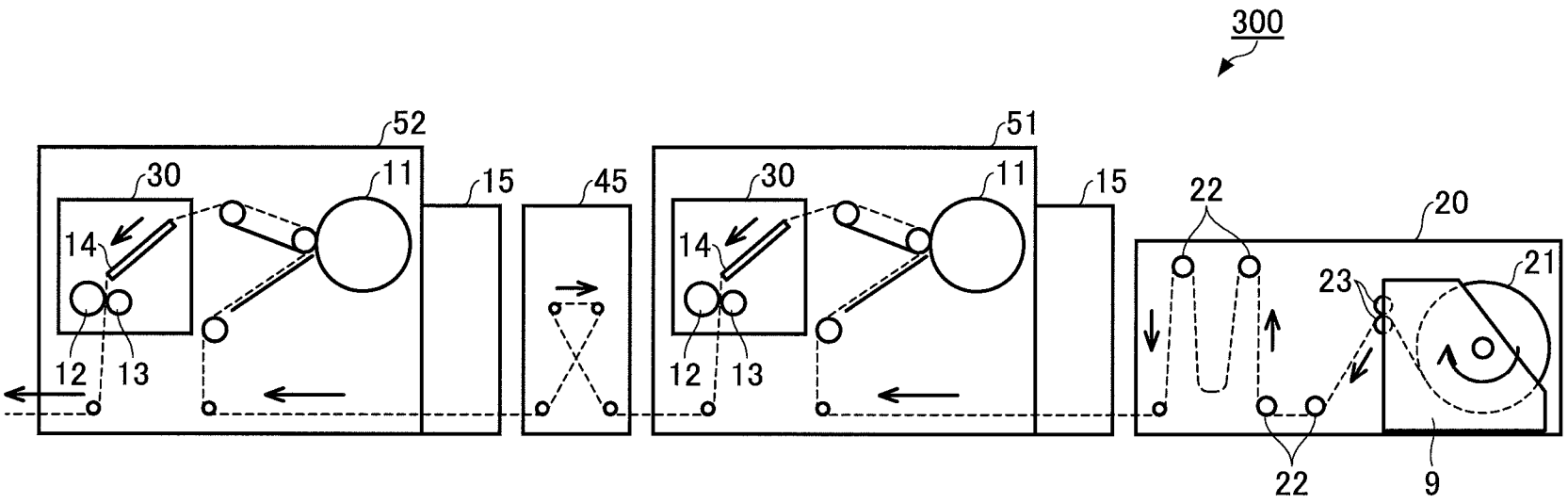
FIG. 8 is a view illustrating a structure of an image forming apparatus according to a third embodiment of the present invention.

FIG. 8 illustrates an outline structure of an image forming apparatus 300 according to a third embodiment of the present invention.

The image forming apparatus 300 stores the continuous recording paper 21. The image forming apparatus 300 includes the conveyance apparatus 20, the first printing apparatus 51, the first print control apparatus for controlling the first printing apparatus 51, the recording-paper reversing apparatus 45, the second printing apparatus 52, and the second print control apparatus 15 for controlling the second printing apparatus. The first printing apparatus 51 prints a toner image on one side of the continuous recording paper 21 being conveyed. The recording-paper reversing apparatus 45 reverses the recording paper 21 ejected from the first printing apparatus 51. The second printing apparatus 52 prints a toner image on the other side of recording paper 21.

The fixing apparatus provided in each of the first and second printing apparatuses includes the heater unit 31 incorporated in the heating roller 12. The heater unit 31 is capable of heating the opposite end portions and the middle portion of the heating roller 12 in a width direction perpendicular to a conveyance direction of the recording paper 21 on an individual area basis so that the surface temperature of the heating roller can be controlled on an individual area basis.

Accordingly, even if a printing operation is not performed for a long period of time and a deformation is generated in portions of the recording paper retained by the conveyance rollers 22 and 23 in the conveyance apparatus 20, a fixed image having no defect can be obtained by performing a fixing operation by controlling the surface temperature of the opposite end portions of the heating roller 12 to be higher than the surface temperature of the middle portion of the heating roller 12.

Moreover, a good fixed image can be obtained without generation of a fixing defect by performing the same control as mentioned above in the fixing apparatus 30 of the second printing apparatus 52 even when a printing operation is interrupted due to a failure such as an error and paper jamming during printing and a deformation is generated in a portion of the recording paper 21 located in the vicinity of the fixing part 33 of the fixing apparatus 30 of the first printing apparatus 51.

Fourth Embodiment

Figure 9:
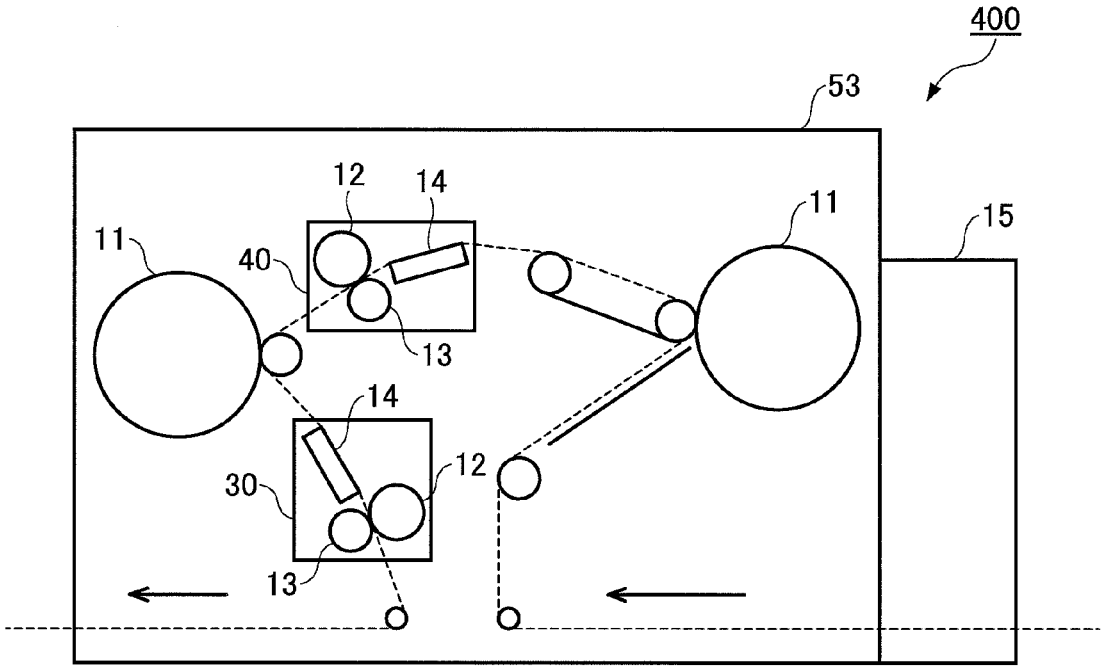
FIG. 9 is a view illustrating a structure of an image forming apparatus according to a fourth embodiment of the present invention.

FIG. 9 illustrates a structure of an image forming apparatus 400 according to a fourth embodiment of the present invention.

The image forming apparatus 400 includes a printing apparatus 53 and the print control apparatus 15. The printing apparatus 53 includes two photosensitive drums 11, image forming parts such as a charger and a developer (not illustrated in the figure) provided around the photosensitive drums 11, respectively, the first fixing apparatus 40, and the second fixing apparatus 30 in order to perform a double-printing on the continuous recording paper 21. Although not illustrated in FIG. 9, the printing apparatus 53 includes a heater power supply and a controller for controlling the heater power supply such as illustrated in FIG. 2.

The surface temperature of the heating roller 12 incorporated in the second fixing apparatus 30 is controlled by the heater unit 31 provided inside the heating roller 12 so that the temperature of the opposite end portions of the heating roller 12 and the temperature of the middle portion of the heating roller 12 can be controlled on an individual area basis.

In the image forming apparatus 400 having the above-mentioned structure, if a printing operation is interrupted due to a failure such as an error and paper jamming during printing and the stopped state continues for a long time, a deformation may be generated in a portion of the recording paper 21 located in the vicinity of the fixing part 33 of the first fixing apparatus 40. Even in such a case, a fixing defect can be prevented by controlling the temperature of the opposite end portions of the heating roller 12 to be higher than the temperature of the middle portion of the heating roller 12 at the time of performing the fixing operation on the deformed portion of the recording paper 21 in the second fixing apparatus 30.

Fifth Embodiment

Figure 10:
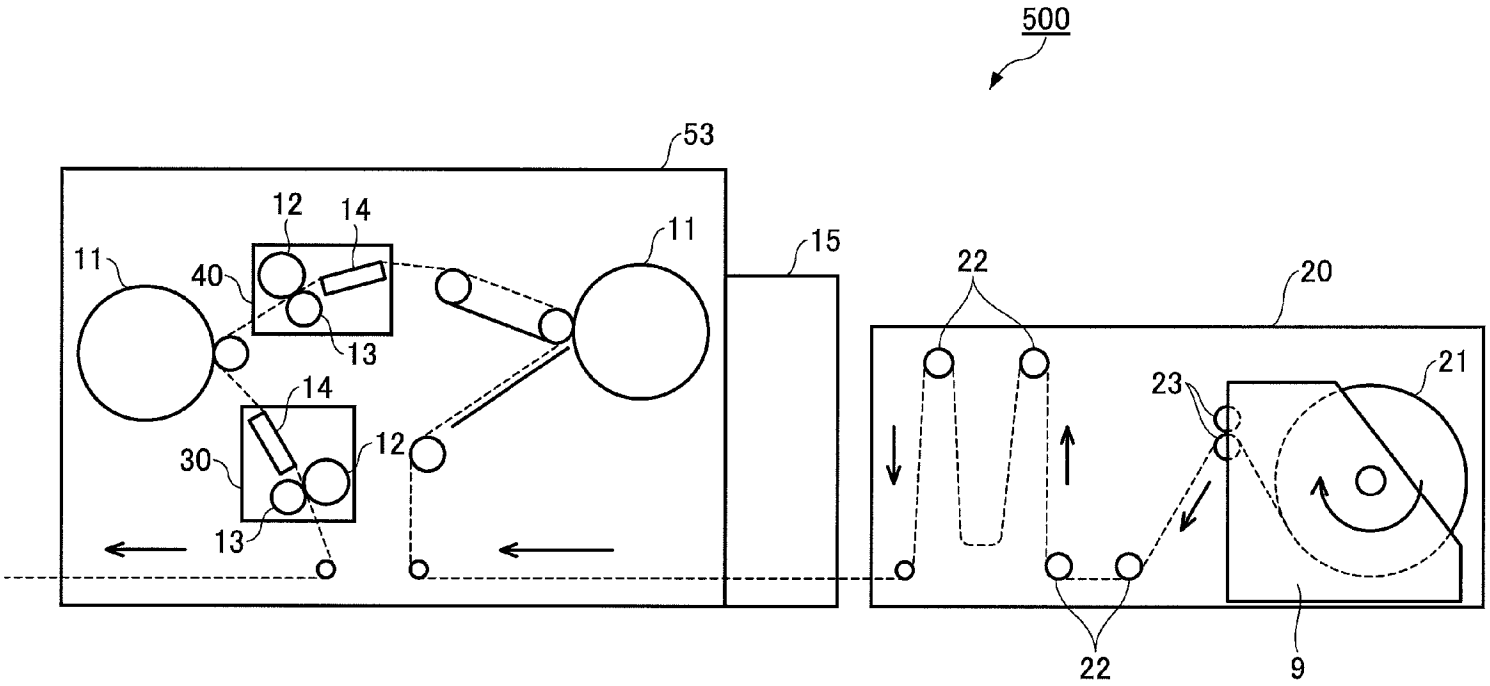
FIG. 10 is a view illustrating a structure of an image forming apparatus according to a fifth embodiment of the present invention.

FIG. 10 illustrates a structure of an image forming apparatus 500 according to a fifth embodiment of the present invention.

The image forming apparatus 500 includes the conveyance apparatus 20, the print control apparatus 15, and the printing apparatus 53. The conveyance apparatus 20 stores the continuous recording paper 21 and supplies the recording paper 21 to the printing apparatus 53. The printing apparatus 53 includes two photosensitive drums 11, image forming parts such as a charger and a developer (not illustrated in the figure) provided around the photosensitive drums 11, respectively, the first fixing apparatus 40, and the second fixing apparatus 30 in order to perform a double side printing on the continuous recording paper 21.

Each of the fixing apparatuses 30 and 40 is configured to be capable of controlling the surface temperature of the heating roller 12 by the heater unit 31 provided in the heating roller 12 so that the temperatures of the opposite end portions and the middle portion of the heating roller 12 can be controlled on an individual area basis.

Therefore, even if a deformation is generated in portions of the recording paper 21 retained by the conveyance rollers 22 and 23 in the conveyance apparatus 20 because a printing operation is not performed for a long time, a fixing operation can be performed without trouble by controlling the surface temperature of the opposite end portions of the heating rollers to be higher than the temperature of the middle portion of the heating roller 12.

Moreover, even if a deformation is generated in a portion of the recording paper 21 located in the vicinity of the fixing part of the first fixing apparatus 40 when a printing operation is interrupted due to a failure such as an error in printing or paper jamming, a fixing defect can be prevented from being occurred by performing the same control as mentioned above in the second fixing apparatus 30.

Sixth Embodiment

Figure 11:
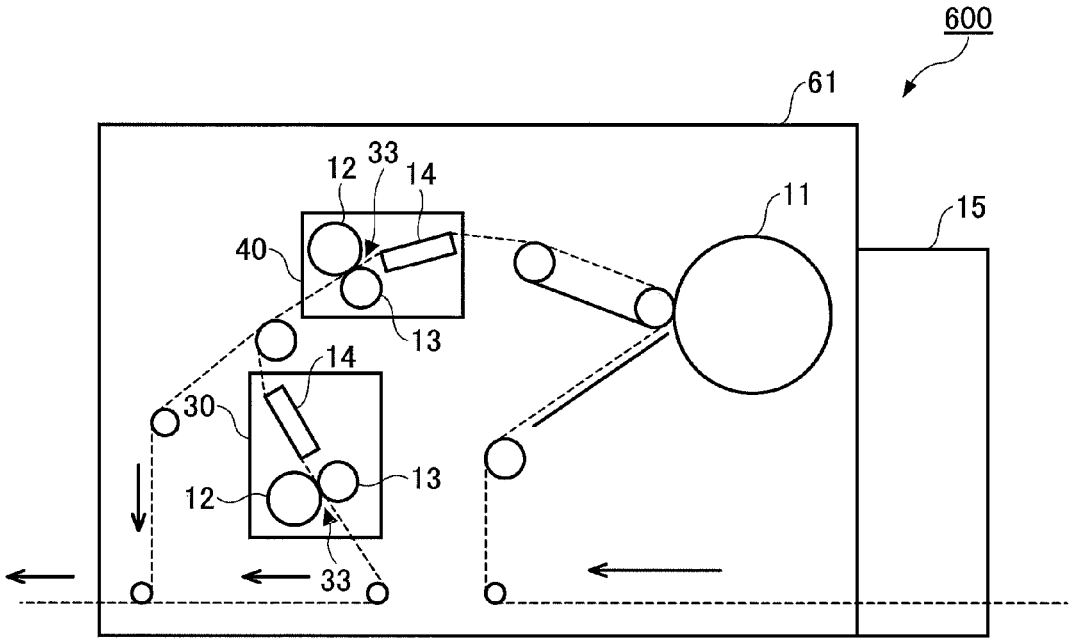
FIG. 11 is a view illustrating a structure of an image forming apparatus according to a sixth embodiment of the present invention.

FIG. 11 illustrates a structure of an image forming apparatus 600 according to a sixth embodiment of the present invention.

The image forming apparatus 600 includes a printing apparatus 61 and the print control apparatus 15. The printing apparatus 61 incorporates the first fixing apparatus 40 and the second fixing apparatus 30 therein. Although not illustrated in FIG. 11, the printing apparatus 61 includes a heater power supply and a controller for controlling the heater power supply such as illustrated in FIG. 2. The image forming apparatus 600 can fix a toner image transferred to one side of the recording paper 21 by using the two fixing apparatuses 30 and 40.

The printing apparatus 61 is equipped with a conveyance path change mechanism (not illustrated in the figure) for the recording paper 21 so that the recording paper 21 passed through the first fixing apparatus 40 can be ejected outside the apparatus without passing through the second fixing apparatus 30.

According to the conveyance path change mechanism being provided to the printing apparatus 61, a sufficient amount of heat and pressure can be applied to the recording paper 21 by using the two fixing apparatuses 30 and 40 if the recording paper 21 is a thick paper or an amount of unfixed toner is large, and a fixing operation is performed by only the first fixing apparatus 40 if the recording paper 21 is a thin paper or an amount of unfixed toner is small. That is, usage of the two fixing apparatuses 30 and 40 can be changed according to various conditions such as a kind of paper and an amount of unfixed toner.

Moreover, it is known that usually the gloss of a fixed image is variable according to an amount of heat applied to a toner. Specifically, a toner image turns to a low-glossy image if an amount of heat is small, and a toner image turns to a high-glossy image if an amount of heat is large. Thus, in the printing apparatus 61, when outputting a low-glossy fixed image, a fixing operation can be performed by only the first fixing apparatus 40, and, on the other hand, when outputting a high-glossy fixed image, a further amount of heat is applied to the toner image by using the second fixing apparatus 30. Accordingly, the gross of a fixed image can be controlled by changing an amount of heat applied to a toner by selectively using the two fixing apparatuses 30 and 40.

It should be noted that the second fixing apparatus 30 is configured and arranged to be capable of controlling the surface temperature of the heating roller 12 by the heater unit 31 provided inside the heating roller 12 so that the surface temperatures of the opposite end portions and the middle portion of the heating roller 12 in a width direction perpendicular to a conveyance direction of the recording paper 21 are controlled on an individual area basis.

Here, for example, in a case of performing a printing operation using the two fixing apparatuses 30 and 40, if the printing operation is interrupted due to a failure such as an error in the printing or paper jamming and the stopped state continues for a long time, a deformation may be generated in a portion of the recording paper located in the vicinity of the fixing part 33 of the first fixing apparatus 40. Even in such a case, a fixing defect can be prevented from being occurred by controlling the surface temperature of the opposite end portions of the heating roller 12 to be higher than the surface temperature of the middle portion of the heating roller 12 at the time of performing a fixing operation on the deformed portion of the recording paper 21.

As mentioned above, according to the embodiments of the present invention, a good fixed image can be obtained without a fixing defect because an unfixed toner image formed on the continuous recording paper 21 can be heated sufficiently by the temperature control of the heating roller 12 when a deformation is generated in the opposite ends of the continuous recording paper 21 due to portions of the recording paper 21 being retained by the conveyance rollers 22 and 23 while a printing operation is stopped or a portion of the recording paper 21 being located in the vicinity of the fixing part 33 while a printing operation is interrupted.

The present invention is not limited to the specifically disclosed embodiments, and variations and modifications may be made without departing from the scope of the present invention.

The present invention is not limited to one of the embodiments mentioned above, and two or more of the embodiments may be combined to achieve the object of the present invention.

The present application is based on Japanese priority application No. 2011-052192 filed on Mar. 9, 2011, the entire contents of which are hereby incorporated herein by reference.

What is claimed is:

1. An image forming apparatus comprising a printing apparatus that includes a fixing apparatus, the fixing apparatus including:

a pre-heating member configured to preheat an unfixed toner transferred to a continuous recording medium being conveyed;

a heating member configured to melt and fix the unfixed toner;

a heat controller configured to control temperatures of opposite end portion areas and a middle portion area of a surface of the heating member in a width direction perpendicular to a conveyance direction of the continuous recording medium on an individual area basis;

a pressure member configured to be pressed against and contact with the heating member; and a fixing part formed between the heating member and the pressure member, the unfixed toner being fixed in the fixing part, wherein the heat controller controls the temperatures of the surface of the heating member so that the temperature of at least one of the opposite end portion areas of the surface of the heating member is higher than the temperature of the middle portion area of the surface of the heating member, wherein the heat controller controls the temperatures of the surface of the heating member, after a previously set length of the continuous recording medium has passed through the fixing part, so that the temperature of the at least one of the opposite end portion areas is lowered stepwisely to the temperature of the middle portion area.

2. The image forming apparatus as claimed in claim 1, further comprising a conveyance apparatus configured to convey and supply the continuous recording medium by carrying the continuous recording medium by a plurality of conveyance rollers, and wherein, when the printing apparatus starts a printing operation and when portions of the continuous recording medium that have been carried by the conveyance rollers of the conveyance apparatus pass through the fixing part, the heat controller controls the temperatures of the surface of the heating member so that the temperature of at least one of the opposite end portion areas of the surface of the heating member is higher than the temperature of the middle portion area of the surface of the heating member.

3. The image forming apparatus as claimed in claim 1, wherein the temperature of the middle portion area, to which the temperature of the at least one of the opposite end portion areas is lowered stepwisely, is higher than a control temperature for a non-printing time.

4. The image forming apparatus as claimed in claim 1, wherein the temperature of the at least one of the opposite end portion areas is a temperature between an edge of the continuous recording medium and the middle portion area in a width direction of the continuous recording medium, the width direction crossing the direction in which the continuous recording medium is conveyed.

5. The image forming apparatus as claimed in claim 1, wherein a temperature range from the temperature of the at least one of the opposite end portion areas to the temperature of the middle portion area is divided into at least a first range and a second range, and the temperature of the at least one of the opposite end portion areas is lowered to the lowest temperature within the first range upon the occurrence of a predetermined condition.

6. The image forming apparatus as claimed in claim 5, wherein the temperature of the at least one of the opposite end portion areas is gradually lowered to the lowest temperature within the second range upon the occurrence of another predetermined condition.

7. An image forming apparatus comprising a printing apparatus that includes a first and second fixing apparatuses, each of the first and second fixing apparatuses including:

a pre-heating member configured to preheat an unfixed toner transferred to a continuous recording medium being conveyed;

a heating member configured to melt and fix the unfixed toner;

a heat controller configured to control temperatures of a surface of the heating member;

a pressure member configured to be pressed against and contact with the heating member; and a fixing part formed between the heating member and the pressure member, the unfixed toner being fixed in the fixing part, wherein the first fixing apparatus fixes the unfixed toner on one side of the continuous recording medium, and the second fixing apparatus is located on a downstream side of the first fixing apparatus in a conveyance direction of the continuous recording medium so as to fix the unfixed toner on the other side of the continuous recording medium, wherein the heat controller of the second fixing apparatus controls the temperatures of opposite end portion areas of the surface of the heating member of the second fixing apparatus and the temperature of a middle portion area of the surface of the heating member of the second fixing apparatus in a width direction perpendicular to a conveyance direction of the continuous recording medium on an individual area basis, and wherein, when a printing operation is stopped due to a failure and thereafter the printing operation is resumed, and when a portion of the continuous recording medium that has been located in the fixing part of the first fixing apparatus passes through the fixing part of the second fixing apparatus, the heat controller of the second fixing apparatus controls the temperatures of the surface of the heating member of the second fixing apparatus so that the temperature of at least one of the opposite end portion areas of the surface of the heating member of the second fixing apparatus is higher than the surface temperature of the middle portion area of the surface of the heating member of the second fixing apparatus.

8. The image forming apparatus as claimed in claim 7, further comprising a conveyance apparatus configured to convey and supply the continuous recording medium by carrying the continuous recording medium by a plurality of conveyance rollers, wherein the heat controller of the first fixing apparatus controls the temperature of the surface of the heating member so that the temperature of at least one of the opposite end portion areas of the surface of the heating member of the first fixing apparatus is higher than the temperature of the middle portion area of the surface of the heating member of the first fixing apparatus, and wherein, when the printing apparatus starts a printing operation and when portions of the continuous recording medium that have been carried by the conveyance rollers of the conveyance apparatus pass through the fixing part of the first fixing apparatus, the heat controller of the first fixing apparatus controls the temperatures of the surface of the heating member of the first fixing apparatus so that the surface temperature of at least one of the opposite end portion areas of the surface of the heating member of the first fixing apparatus is higher than the temperature of the middle portion area of the surface of the heating member of the first fixing apparatus.

9. The image forming apparatus as claimed in claim 8, wherein, when a time period where the continuous recording medium is stopped by being carried by the conveyance rollers of said conveyance apparatus is equal to or longer than a second predetermined time period, the heat controller of the first fixing apparatus controls the temperatures of the surface of the heating member.

10. The image forming apparatus as claimed in claim 7, wherein, when a time period where the printing operation is stopped due to the failure is equal to or longer than a first predetermined time period, the heat controller of the second fixing apparatus controls the temperatures of the surface of the heating member of the second fixing apparatus.

11. The image forming apparatus as claimed in claim 7, further comprising a check mark sensor that detects a check mark printed on the continuous recording medium so as to detect a time when the portion of the continuous recording medium located in the fixing part of the first fixing apparatus passes through the fixing part of the second fixing apparatus by detecting the check mark by the check mark sensor.

12. The image forming apparatus as claimed in claim 7, further comprising a conveyance path change mechanism to change a direction of conveyance of the continuous recording medium after ejected from the first fixing apparatus between a direction of ejecting the continuous recording medium to outside and a direction toward the second fixing apparatus.

13. An image forming method comprising:

supplying and conveying a continuous recording medium;

forming an unfixed toner image on the continuous recording medium;

preheating the unfixed toner image together with the continuous recording medium; and fixing the unfixed toner image on the continuous recording medium by applying heat from a heating member to the unfixed toner image and the continuous recording medium while controlling a temperature of at least one of opposite end portion areas of a surface of the heating member in a width direction perpendicular to a conveyance direction of the continuous recording medium to be higher than a temperature of a middle portion area of the surface of the heating member, wherein the controlling the temperatures of the surface of the heating member includes, after a previously set length of the continuous recording medium has passed through the heating member, lowering the temperature of the at least one of the opposite end portion areas stepwisely to the temperature of the middle portion area.

14. The image forming method as claimed in claim 13, wherein, when a printing operation is started and when portions of the continuous recording medium that have been carried by conveyance rollers for conveying the continuous recording medium pass through the heating member, the fixing the unfixed toner image includes the controlling the temperatures of the surface of the heating member so that the temperature of at least one of the opposite end portion areas of the surface of the heating member is higher than the temperature of the middle portion area of the surface of the heating member.

15. The image forming method as claimed in claim 13, further comprising:

reversing the continuous recording medium after fixing the unfixed toner image on the continuous recording medium;

forming another unfixed toner image on a backside of the continuous recording medium; and fixing the another unfixed toner image by applying heat from another heating member and the continuous recording medium while controlling a temperature of at least one of opposite end portion areas of a surface of the another heating member in a width direction perpendicular to a conveyance direction of the continuous recording medium to be higher than a temperature of a middle portion area of the surface of the another heating member.

16. The image forming method as claimed in claim 13, further comprising:

after fixing the unfixed toner image, forming another unfixed toner image on a backside of the recording medium; and fixing the another unfixed toner image and the continuous recording medium by applying heat from another heating member while controlling a temperature of at least one of opposite end portion areas of a surface of the another heating member in a width direction perpendicular to a conveyance direction of the continuous recording medium to be higher than a temperature of a middle portion area of the surface of the another heating member.

17. The image forming method as claimed in claim 16, further comprising:

forming a check mark on the continuous recording medium when forming the unfixed toner image on the continuous recording medium; and detecting the check mark to detect a time when a portion of the continuous recording medium that has been subjected to the fixing of the unfixed toner image reaches a position at which the another unfixed toner image is fixed.

18. The image forming method as claimed in claim 13, further comprising:

after fixing the unfixed toner image, changing a direction of conveyance of the continuous recording medium between a direction of ejecting the continuous recording medium to outside and a direction toward a position at which heat is further applied to the fixed toner image on the continuous recording medium.

19. The image forming method as claimed in claim 13, wherein the temperature of the middle portion area, to which the temperature of the at least one of the opposite end portion areas is lowered stepwisely, is higher than a control temperature for a non-printing time.

20. The image forming method as claimed in claim 13, wherein the temperature of the at least one of the opposite end portion areas is a temperature between an edge of the continuous recording medium and the middle portion area in a width direction of the continuous recording medium, the width direction crossing the direction in which the continuous recording medium is conveyed.

21. The image forming method as claimed in claim 13, wherein a temperature range from the temperature of the at least one of the opposite end portion areas to the temperature of the middle portion area is divided into at least a first range and a second range, and the temperature of the at least one of the opposite end portion areas is gradually lowered to the lowest temperature within the first range upon the occurrence of a predetermined condition.

22. The image forming method as claimed in claim 21, wherein the temperature of the at least one of the opposite end portion areas is gradually lowered to the lowest temperature within the second range upon the occurrence of another predetermined condition.

* * * * *